US005483328A

United States Patent [19]

Kawasaki et al.

[11] Patent Number: 5,483,328

[45] Date of Patent: Jan. 9, 1996

[54] TONER SUPPLY CONTROL SYSTEM AND METHOD

[75] Inventors: Noriko Kawasaki; Akihiko Uematsu; Katsumi Sugimoto, all of Kawasaki, Japan

[73] Assignee: Fujitsu, Ltd., Kawasaki, Japan

[21] Appl. No.: 258,603

[22] Filed: Jun. 10, 1994

Related U.S. Application Data

[63] Continuation of Ser. No. 974,214, Nov. 10, 1992, abandoned.

[30] Foreign Application Priority Data

Nov. 11, 1991 [JP] Japan ..... 3-294465

[51] Int. Cl.[6] ..... G03G 21/00

[52] U.S. Cl. ..... 355/246; 355/208

[58] Field of Search ..... 355/245, 246, 355/204, 208, 77

[56] References Cited

U.S. PATENT DOCUMENTS

| | | | |
|---|---|---|---|
| 4,348,099 | 9/1982 | Fantozzi . | |
| 4,669,856 | 6/1987 | Yamada . | |
| 4,870,459 | 9/1989 | Ito et al. | 355/204 X |
| 4,894,685 | 1/1990 | Shoji | 355/246 |
| 4,903,051 | 2/1990 | Egawa et al. | 355/246 X |
| 4,910,557 | 3/1990 | Imai | 355/246 |
| 5,060,013 | 10/1991 | Spence | 355/208 |
| 5,081,491 | 1/1992 | Lux et al. | 355/208 |
| 5,083,160 | 1/1992 | Suzuki et al. | 355/208 |
| 5,103,260 | 4/1992 | Tompkins et al. | 355/208 |
| 5,162,848 | 11/1992 | Saitoh et al. | 355/206 |

FOREIGN PATENT DOCUMENTS

| | | |
|---|---|---|
| 58-121073 | 7/1983 | Japan . |
| 59-10966 | 1/1984 | Japan . |
| 62-147380 | 10/1987 | Japan . |
| 63-106678 | 5/1988 | Japan . |
| 3-279971 | 12/1991 | Japan . |

*Primary Examiner*—Sandra L. Brase
*Attorney, Agent, or Firm*—Staas & Halsey

[57] ABSTRACT

In a toner supply control system for a printing device, a toner supply unit supplies a developing unit of the printing device with a two-component developer containing toner particles and carrier particles in accordance with a first control signal. A storage unit stores information concerning a plurality of toner marks formed on an electrostatic latent image carrying member of the printing device and developed by the developing unit. The toner marks respectively have patterns related to condition of the two-component developer. A selecting unit selects one of the toner marks in accordance with a second control signal. A sensor optically reads the toner mark formed on the electrostatic latent image carrying member and generates a detection signal. A first control unit generates the second control signal on the basis of the condition of the two-component developer. A second control unit generates the first control signal on the basis of the detection signal.

17 Claims, 8 Drawing Sheets

TONER MARK A

TONER MARK B

TONER MARK C

TONER MARK A1

TONER MARK B1

TONER MARK C1

TONER SUPPLY CONTROL SYSTEM AND METHOD

This application is a continuation of U.S. patent application Ser. No. 07/974,214, filed on Nov. 10, 1992, now abandoned.

BACKGROUND OF THE INVENTION

1. Field of the Invention

The present invention generally relates to printing devices in which latent images are developed by means of a two-component developer, and more particularly to a toner supply control system and method for optically detecting the density of a developed latent image of a toner mark and controlling toner supply on the basis of the detected density.

2. Description of the Prior Art

Printing devices are widely used for computers, copying machines, facsimiles and the like. Examples of the printing devices are an electrophotographic printing device and an electrostatic recording device. In such printing devices, latent images are developed by a developer and thereby visual images are formed.

Many printing devices employ a developing process using a two-component developer consisting of a carrier and toner. The developing process consumes toner. Hence, the printing devices are equipped with toner supply units, which supply developing units with toner as necessary.

A toner supply control optically detects the density of a developed latent image of a toner mark, and controls the toner supply on the basis of the detected density.

FIGS. 1, 2A through 2D show an electrophotographic printing device that employs a toner supply control as described above.

Referring to FIG. 1, the printing device comprises a photosensitive drum 10 around which there are provided a corona charger 11, an optical image writing unit 12, a developing unit 13 with a toner supply unit 14, an image transfer unit 15, an AC discharging unit 16, a cleaning unit 17, and an optical density sensor 18. The optical image writing unit 12 includes a light source formed with, for example, a semiconductor laser, a polygonal mirror (optical scanning device), and a mirror which causes a scanning light emitted from the light source to be projected onto the photosensitive drum 10. The developing unit 13 comprises a magnetic roller 130, a supply roller 131, a stirring member 132, and a flow plate 133. The magnetic roller 130 supplies the two-component developer consisting of carriers and toner particles. The supply roller 131 supplies the magnetic roller 130 with the two-component developer. The stirring member 132 stirs and mixes the carriers and toner particles. The flow plate 133 guides the developer remaining on the magnetic roller 130 to the stirring member 132.

The optical density sensor 18 is made up of a light-emitting element (LED) 18*a* and a light receiving element 18*b*, as shown in FIG. 2A. As shown in FIG. 2A, a light from the light-emitting element 18*a* is projected onto a developed image of a toner mark M (FIG. 2B) formed outside a printing area on the photosensitive drum 10. The light receiving element receives the light reflected by the developed image of the toner mark M, and generates a detection voltage dependent on the density of the developed image of the toner mark M.

The electrophotographic printing device operates as follows. The photosensitive drum 10 is uniformly charged by the corona charger 11. The photosensitive drum 10 being rotated is linearly scanned by a light emitted from the optical image writing unit 12 and modulated by a video signal. In this manner, electrostatic latent images are formed on the photosensitive drum 10. The latent images are developed by the developing unit 13. Then, toner images generated by developing are transferred to a sheet transported in a leftward direction by means of transport rollers 30. Thereafter, the sheet is detached from the photosensitive drum 10 by the AC discharging unit 16.

The photosensitive drum 10, after the image transfer process, is subjected to a cleaning process in which remaining toner particles are removed by means of a cleaning brush and a blade of the cleaning unit 17. Then, the sheet is sent to an image fixing unit, in which the images on the sheet are fixed thereon.

The latent image of the toner mark M is formed, under the control of a print controller 2, on the photosensitive drum 10 via the optical image writing unit 12 once per revolution of the photosensitive drum 10. The latent image of the toner mark M is developed in the same manner as the images formed within the image forming area. The sensor 18 optically reads the developed image of the toner mark M and generates a detection voltage dependent on the density of the developed image of the toner mark M.

When the toner mark M has a pattern shown in FIG. 2B, a sensor output (volts) vs. toner density (weight percent) shown in FIG. 2C is obtained. The sensor output obtained with the toner density equal to 4.0 wt % is defined as a slice or reference level, which is stored in the print controller 2. The output signal of the light-receiving element 18*b* of the optical density sensor 18 is compared with the reference level in the print controller 2. When the output signal of the sensor 18 is less than or equal to the reference level, it is determined that the toner density is low. In this case, the print controller 2 drives the supply motor 143 in order to rotate the supply roller 142, so that toner is supplied to the developing unit 13 from a toner reservoir 140 of the toner supply unit 14. In this manner, the toner density is regulated at a fixed level.

As is known, the two-component developer deteriorates in the progress of use thereof, and the developing characteristic thereof changes. This mainly results from deterioration of carrier particles, particularly, surface variations thereof. For example, when the two-component developer is used for a long time, toner particles adheres to the surfaces of carrier particles because of friction between the toner particles and the carrier particles. This increases the electric resistance of the carrier particles and changes the developing characteristic. Hence, the print image density becomes low.

The above phenomenon causes the following problems. The print image density of the toner mark M decreases as the number of printed sheets increases even when the toner density is maintained at a constant level. Further, the output signal of the sensor 18 decreases and the slope of the sensor output signal vs. toner density characteristic becomes small as the number of printed sheets increases, as shown in FIG. 2C.

The change in the characteristic shown in FIG. 2C causes the following problems. In the case where toner is supplied so that the sensor output level is maintained at the reference level, the developing characteristic of the developer varies and hence the print image density tends to decrease even for the same toner density as the number of printed sheets increases. Hence, the toner mark density detected by the sensor 18 does not increase in proportion as the toner density increases. Hence, as shown in FIG. 2D, the toner density continues to increase, and the toner mark density does not correctly reflect the toner density.

There is an upper limit regarding the toner density. As the toner density increases, sufficient stirring cannot be carried out. This increases uncharged toner particles and noise will appear on the background of images. Further, toner particles are liable to be scattered because of uncharged toner particles and the inside of the device is contaminated.

If a sensor output lower than the reference level shown in FIG. 2C is defined as the reference level in order to suppress an increase in the toner density and prevent occurrence of uncharged toner particles, the print image density decreases and the detection sensitivity of the toner density decreases (the slope of the sensor output vs. toner density characteristic becomes small). As a result, the range within which the sensor output varies in response to a decrease in the print image density becomes narrow, and hence the toner supply control cannot be performed with high precision.

SUMMARY OF THE INVENTION

It is a general object of the present invention to provide a toner supply control system and a method in which the above disadvantages are eliminated.

A more specific object of the present invention is to provide a toner supply control system and a method in which the print image density can be maintained at a fixed level even after a two-component developer has been used for a long time, and occurrence of noise and scattering of toner particles because of uncharged toner particles can be prevented.

The above objects of the present invention are achieved by a toner supply control system for a printing device comprising: toner supply means for supplying a developing unit of the printing device with a two-component developer containing toner particles and carrier particles in accordance with a first control signal; storage means for storing information concerning a plurality of toner marks formed on an electrostatic latent image carrying member of the printing device and developed by the developing unit, the toner marks respectively having patterns related to the condition of the two-component developer; selecting means, coupled to the storage means, for selecting one of the toner marks in accordance with a second control signal; sensor means for optically reading the above one of the toner marks formed on the electrostatic latent image carrying member and for generating a detection signal; first control means, coupled to the selecting means and the storage means, for generating the second control signal on the basis of the condition of the two-component developer and; second control means, coupled to the toner supply means and the sensor means, for generating the first control signal on the basis of the detection signal.

The above objects of the present invention are also achieved by a toner supply control method for a printing device comprising the steps of: (a) detecting the condition of a two-component developer containing toner particles and carrier particles; (b) selecting one of a plurality of toner marks formed on an electrostatic latent image carrying member of the printing device and developed by a developing unit supplied with the two-component developer, the toner marks respectively having patterns related to the condition of the two-component developer; (c) optically reading the above one of the toner marks formed on the electrostatic latent image carrying member and generating a detection signal; (d) and determining, on the basis of the detection signal, whether or not toner should be supplied to the developing unit.

Another object of the present invention is to provide a printing device having the above-mentioned toner supply control system.

This object of the present invention is achieved by a printing device comprising: an electrostatic latent image carrying member; a developing unit; toner supply means for supplying the developing unit of the printing device with a two-component developer containing toner particles and carrier particles in accordance with a first control signal; storage means for storing information concerning a plurality of toner marks formed on the electrostatic latent image carrying member of the printing device and developed by the developing unit, the toner marks respectively having patterns related to the condition of the two-component developer; selecting means, coupled to the storage means, for selecting one of the toner marks in accordance with a second control signal; sensor means for optically reading the one of the toner marks formed on the electrostatic latent image carrying member and for generating a detection signal; first control means, coupled to the selecting means and the storage means, fop generating the second control signal on the basis of the condition of the two-component developer and; second control means, coupled to the toner supply means and the sensor means, for generating the first control signal on the basis of the detection signal.

BRIEF DESCRIPTION OF THE DRAWINGS

Other objects, features and advantages of the present invention will become more apparent from the following detailed description when read in conjunction with the accompanying drawings, in which.

DESCRIPTION OF THE PREFERRED EMBODIMENT

A description will now be given, with reference to FIGS. 3, 4A–4C, of an overview of an embodiment of the present invention.

Figure 1:
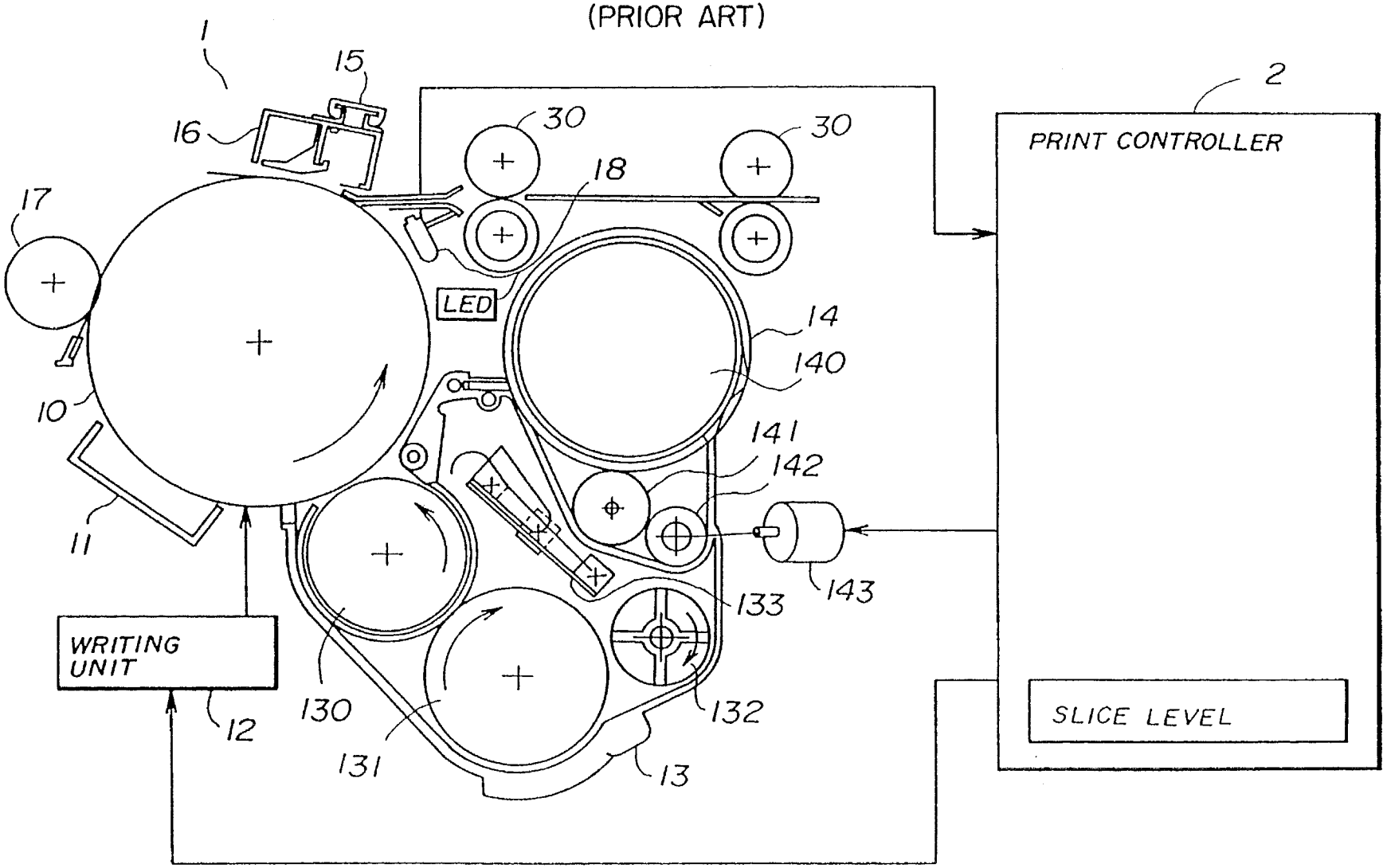
FIG. 1 (PRIOR ART)
FIG. 1 is a side view of an electrophotographic printing device.
Figure 3:
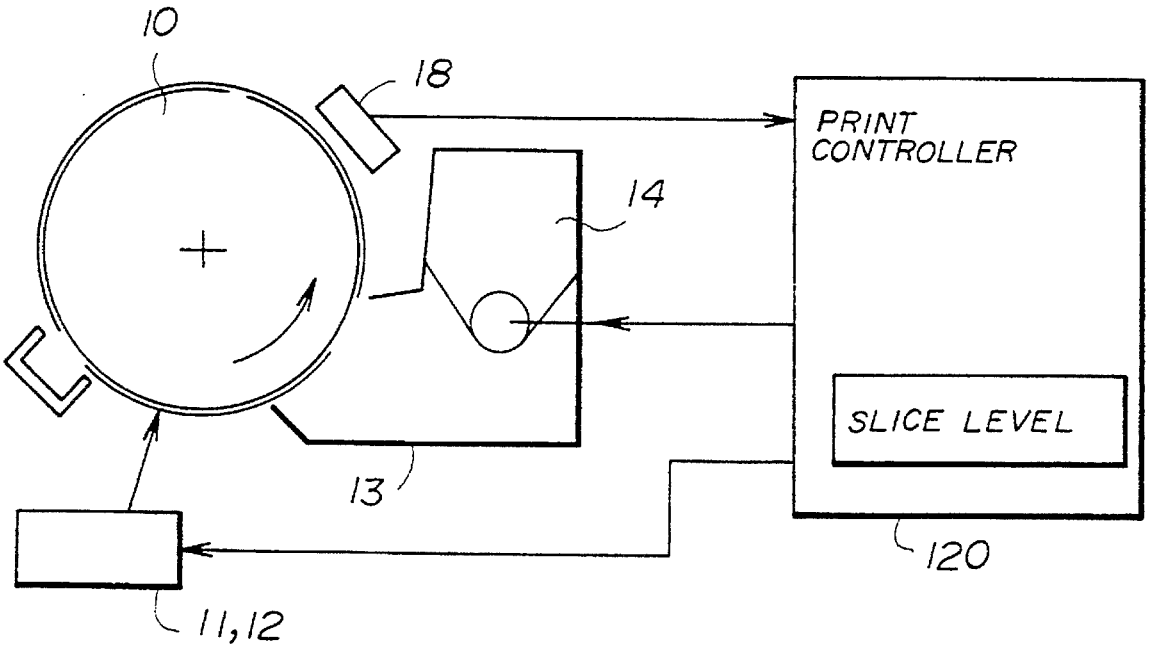
FIG. 3 is a block diagram illustrating an overview of an embodiment of the present invention.
Figure 4A:
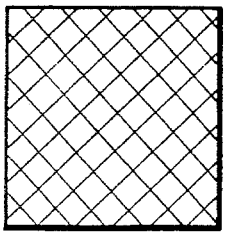
FIGS. 4A, 4B and 4C are diagrams showing toner marks used in the embodiment of the present invention.
Figure 4B:
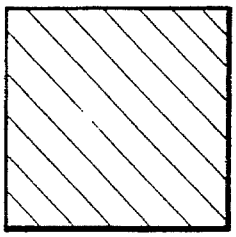
Figure 4C:
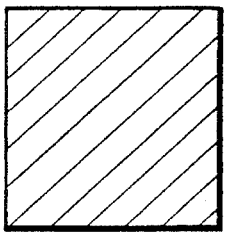

FIG. 3 shows a printing device of the embodiment. In FIG. 3, parts that are the same as parts shown in FIG. 1 are given the same reference numbers as previously. According to the embodiment of the present invention, as shown in FIG. 4A, 4B and 4C, a plurality of toner marks A, B and C respectively having different patterns are used. A controller 120 stores information concerning the toner marks A, B and C, and selects one of them in the progress of use of a two-component developer. For example, the controller 120 counts the number of printed sheets, and selects one of the toner marks A, B and C on the basis of the number of printed sheets. For example, when the number of printed sheets is equal to or less than n (n is an integer), the toner mark C is selected. When the number of printed sheets is between n and m (m is an integer and larger than n), the toner mark B is selected. When the number of printed sheets is equal to or larger than m, the toner mark A is selected.

Alternatively, the controller 120 measures the working time of the two-component developer, and selects one of the toner marks A, B and C on the basis of the working time.

As has been described previously, the sensor output signal obtained by means of a single toner mark does not reflect the toner density when the developing characteristic of the developer changes. The toner marks A, B and C have respective patterns dependent on different developing characteristics.

A description will now be given of the details of the embodiment of the present invention.

Figure 5:
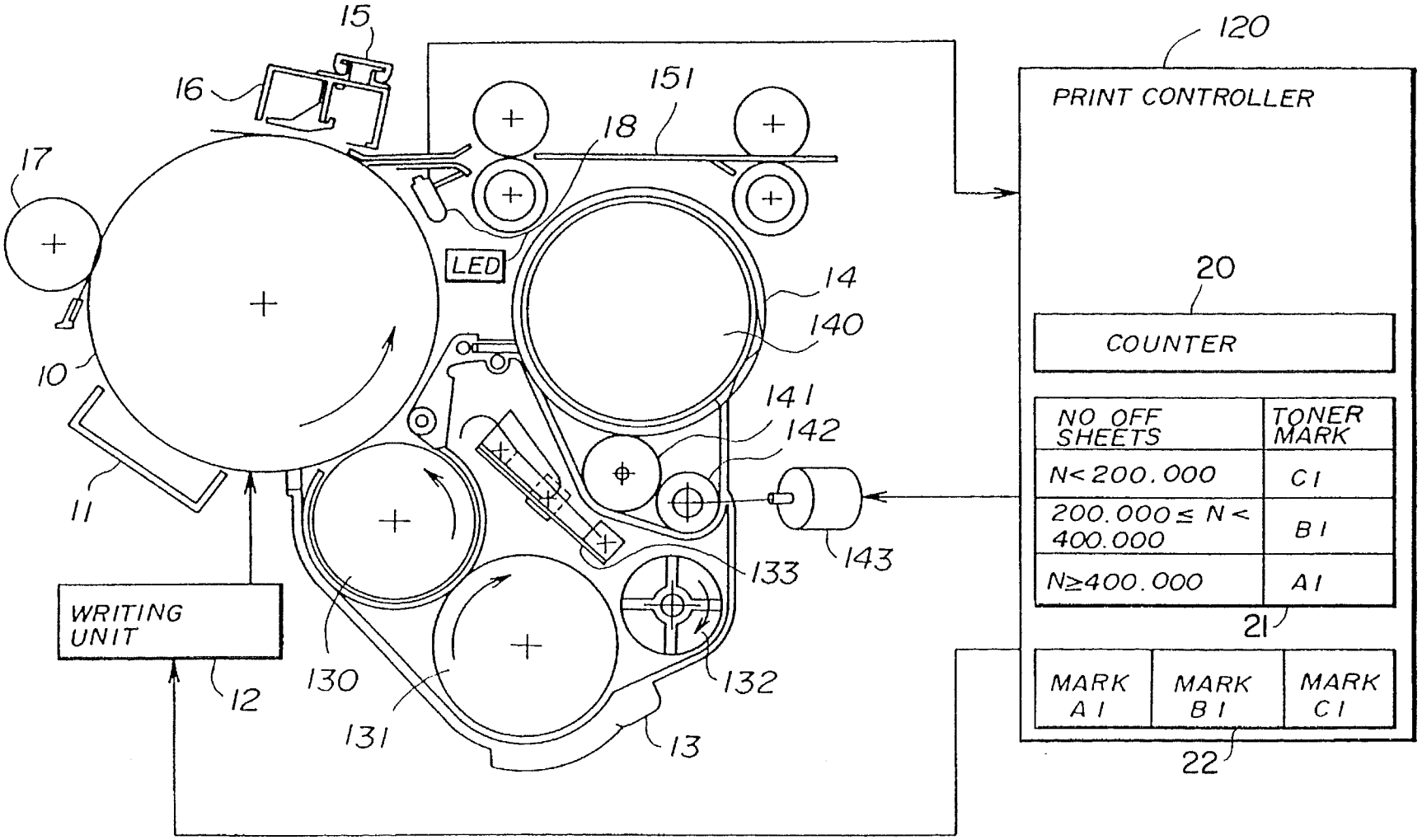
FIG. 5 is a side view showing the details of the embodiment of the present invention shown in FIG. 3.

FIG. 5 shows the electrophotographic printing device according to the embodiment of the present invention. In FIG. 5, parts that are the same as parts shown in the previously described figures are given the same reference numbers as previously. The print controller 120 comprises a counter 20 that counts the number of printed sheets, a toner mark selecting table 21, and a pattern storage unit 22. The toner mark selecting table 21 stores ranges of the number of printed sheets and identification information concerning the corresponding toner marks. As will be described in detail, the present embodiment uses three toner marks A1, B1 and C1 respectively having different patterns. The pattern storage unit 22 stores the patterns of the toner marks A1, B1 and C1.

Figure 6:
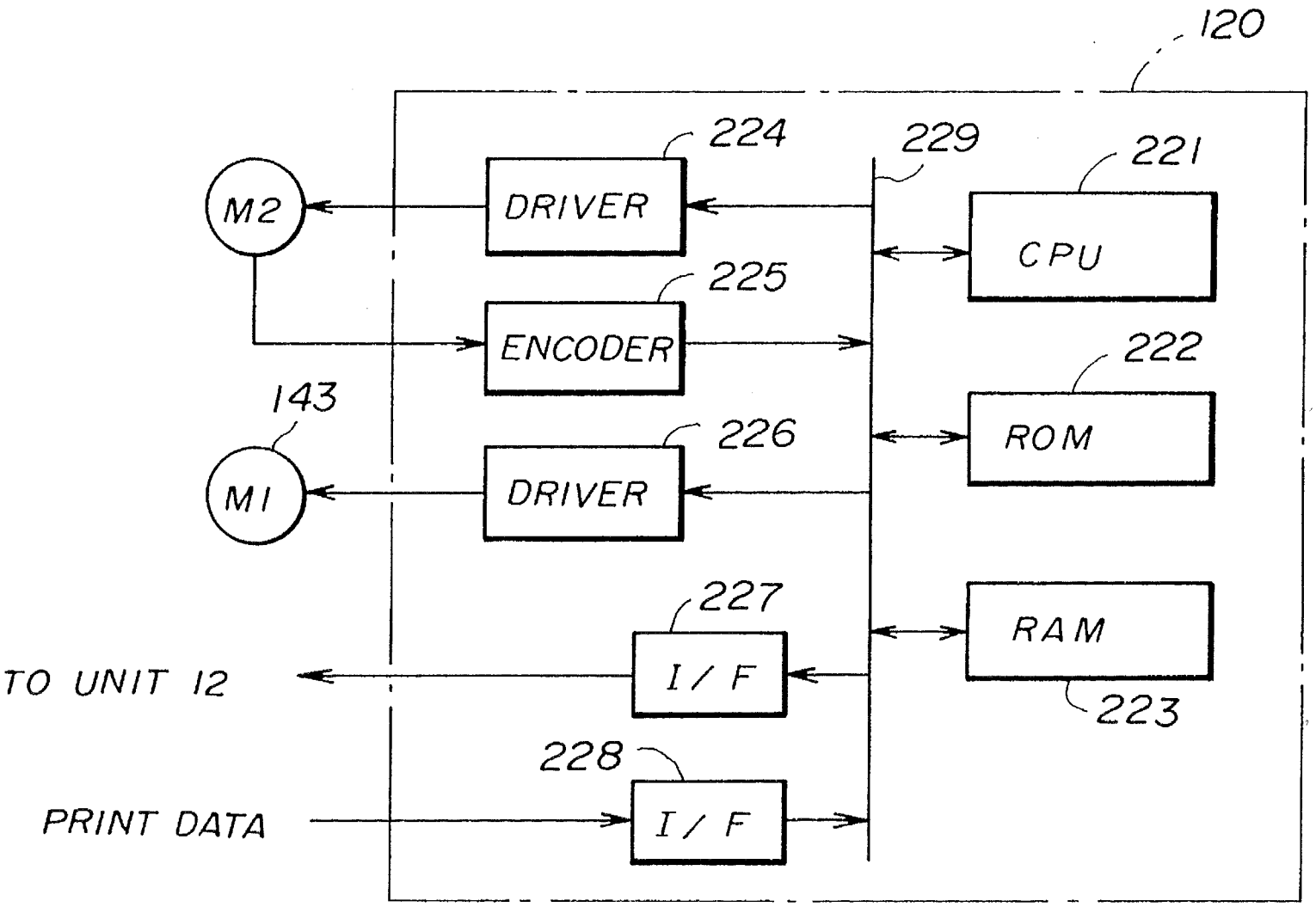
FIG. 6 is a block diagram of a print controller shown in FIGS. 3 and 5.

In practice, the print controller 120 is configured as shown in FIG. 6. The print controller 120 comprises a CPU (Central Processing Unit) 221, a ROM (Read Only Memory) 222, a RAM (Random Access Memory) 223, a driver 224, an encoder 225, a driver 226, interfaces (I/F) 227 and 228, and a bus 229. The counter 20 shown in FIG. 5 corresponds to the CPU 221. The table 21 and the storage unit 22 correspond to the ROM 222. A motor M2 drives the photosensitive drum 10 in accordance with a control signal supplied from the CPU 221 via the driver 224. A rotary encoder 225 counts pulses corresponding to rotations of the motor M2. The CPU 221 determines the number of printed sheets or the working time of the printing device on the basis of the output signal of the rotary encoder 225. The supply motor (M1) 143 is rotated by the CPU 221 via the driver 226. Print data from the CPU 221 is sent to the optical image writing unit 12 via the interface 227. The ROM 222 stores various programs necessary to control the entire printing device. The RAM 223 serves as a working area of the CPU 221 and temporarily stores various pieces of information, such as print data externally supplied from, for example, a host computer, via the interface 228. Further, the RAM 223 has a non-volatile storage area for storing the number of printed sheets counted by the counter 20.

Figure 7A:
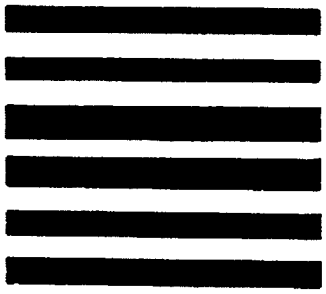
FIGS. 7A, 7B and 7C are diagrams showing other toner marks used in the embodiment of the present invention.
Figure 7B:
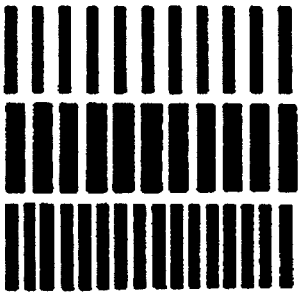
Figure 7C:
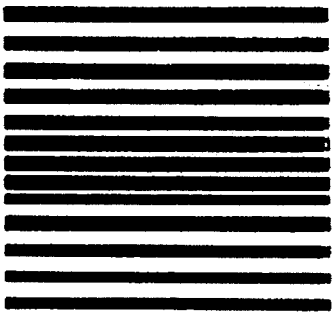

FIGS. 7A, 7B and 7C respectively show the toner marks A1, B1 and C1. The toner mark A1 shown in FIG. 7A includes a small number of thick lines spaced apart from each other and arranged in parallel. The toner mark B1 shown in FIG. 7B includes three blocks arranged side by side. One of the three blocks includes N1 thick lines arranged side by side, and another one of the three blocks includes N2 (>N1) thin lines arranged side by side. The remaining block includes N3 (>N2) thin lines arranged side by side. The thickness of the N3 thin lines is approximately equal to that of the N2 thin lines. All the lines of the toner mark B1 run in the same direction. The toner mark C1 shown in FIG. 7C includes lines arranged at small intervals and large intervals. The lines arranged at small intervals are located at the center portion of the toner mark C1 and the lines arranged at large intervals are located on both sides of the block of the lines arranged at small intervals.

Figure 8:
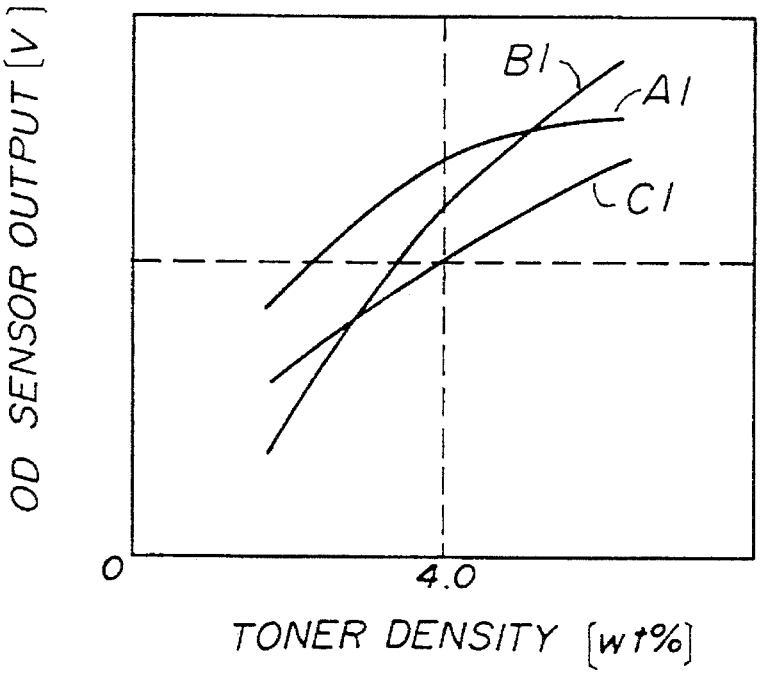
FIG. 8 is a graph of sensor output signal vs. toner density characteristics of the embodiment of the invention.

FIG. 8 shows the initial sensor output vs. toner density characteristics of the toner marks A1, B1 and C1. For a toner density of 4.0 wt %, the sensor output signal for the toner mark A1 is greater than that for the toner mark B1, which is greater than that for the toner mark C1. While the toner mark C1 is optimal for the initial developing characteristic of the two-component developer, the toner mark B1 is optimal for a deteriorated condition of the developer, and the toner mark A1 is optimal for a further deteriorated condition thereof. In this case, the toner marks C1, B1 and A1 are selected one by one in that order in the progress of use of the developer.

The toner mark selecting table 21 shown in FIG. 5 shows that the toner mark C1 should be selected when the number of printed sheets is less than 200,000, and the toner mark B1 should be selected when the number of printed sheets is equal to or greater than 200,000 and less than 400,000. Further, the table 21 shows that the toner mark A1 should be selected when the number of printed sheets is greater than 400,000.

A description will now be given, with reference to FIGS. 9, 10A and 10B, of the operation of the embodiment of the present invention. When a sheet is subjected to the printing process, the counter value of the counter 20 is incremented by 1 (step S11). In step S11, the CPU 221 receives a pulse generated by the encoder 225 and increments the counter value of the built-in program counter 20 by 1. In lieu of the encoder 225, it is possible to employ an element pair consisting of a light-emitting element and a light-receiving element located in a sheet transport path 151 (FIG. 5) extending to the photosensitive drum 10. Then, the CPU 221 makes a decision by identifying the range within which the counter value N of the counter 20 falls (step S12). The counter value N indicates the number of sheets that have been processed for printing. When $0 \leqq N < 200{,}000$, the CPU 221 selects the toner mark C1, and reads information indicating the toner mark C1 from the storage unit 22 (the ROM 222). The read information is sent to the optical image writing unit 12 via the interface 227. The pattern of the toner mark C1 is recorded on the photosensitive drum 10.

The CPU 221 reads the output signal V of the sensor 18 (step S16), and compares the output signal V with a threshold level SL (step S17). When $V \leqq SL$, the CPU 221 drives the motor 143 via the driver 226 so that it rotates a predetermined number of times. Hence, toner is supplied to the developing unit 13. When V> SL, the motor 143 is not driven. Then, the process returns to step S11.

Figure 10A:
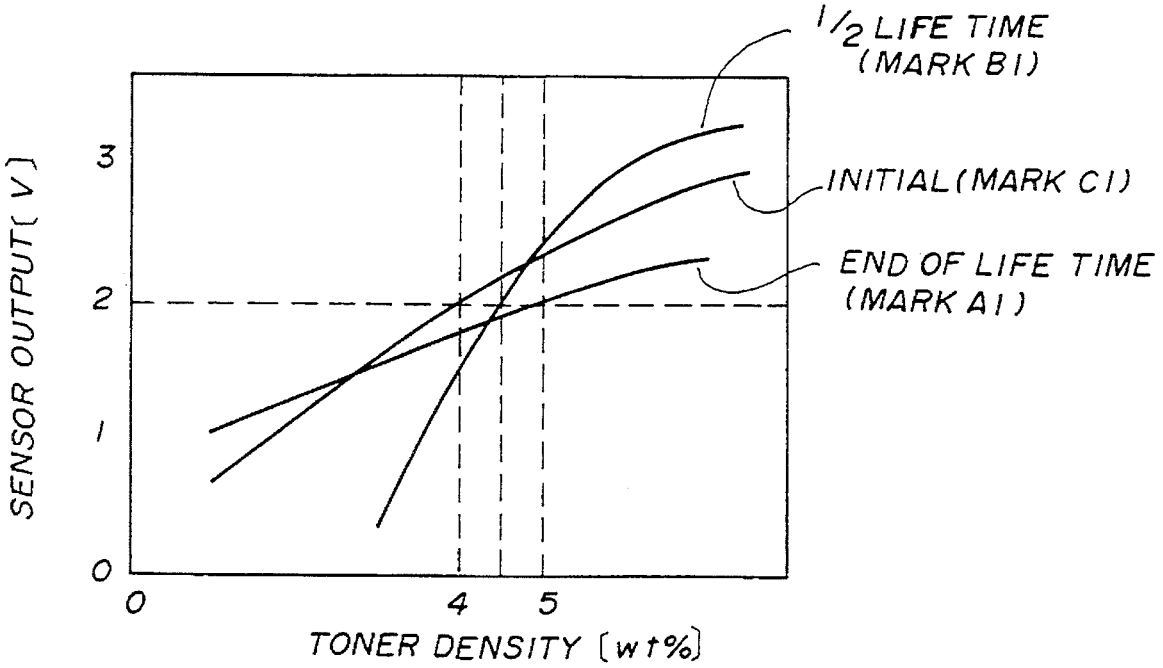
FIGS. 10A and 10B are graphs showing the operation of the embodiment of the present invention.

As shown by the characteristic curve for the toner mark C1 in FIG. 10A, the real toner density approximately coincides with a target toner density of 4 wt % with respect to the threshold level SL, which is set equal to 2 V.

Figure 2A:
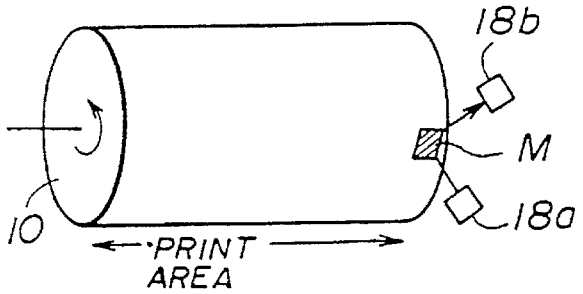
FIG. 2A (PRIOR ART)
FIGS. 2A, 2B, 2C and 2D are diagrams showing the operation of the printing device shown in FIG. 1.
Figure 2B:
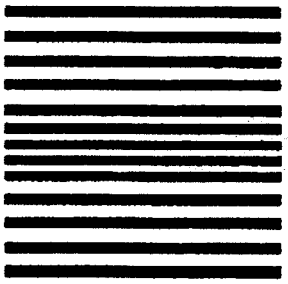
FIG. 2B (PRIOR ART)
Figure 2C:
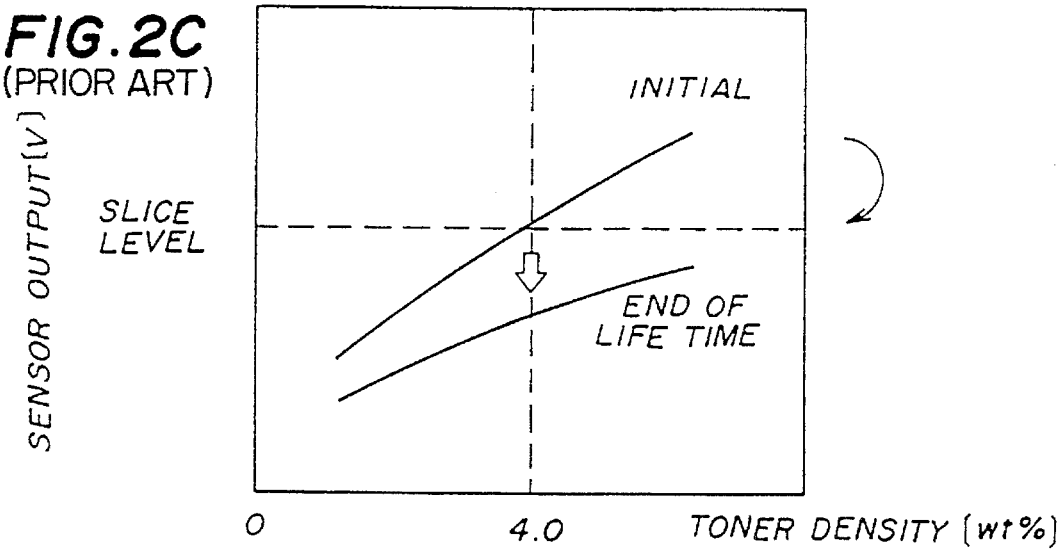
FIG. 2C (PRIOR ART)
Figure 2D:
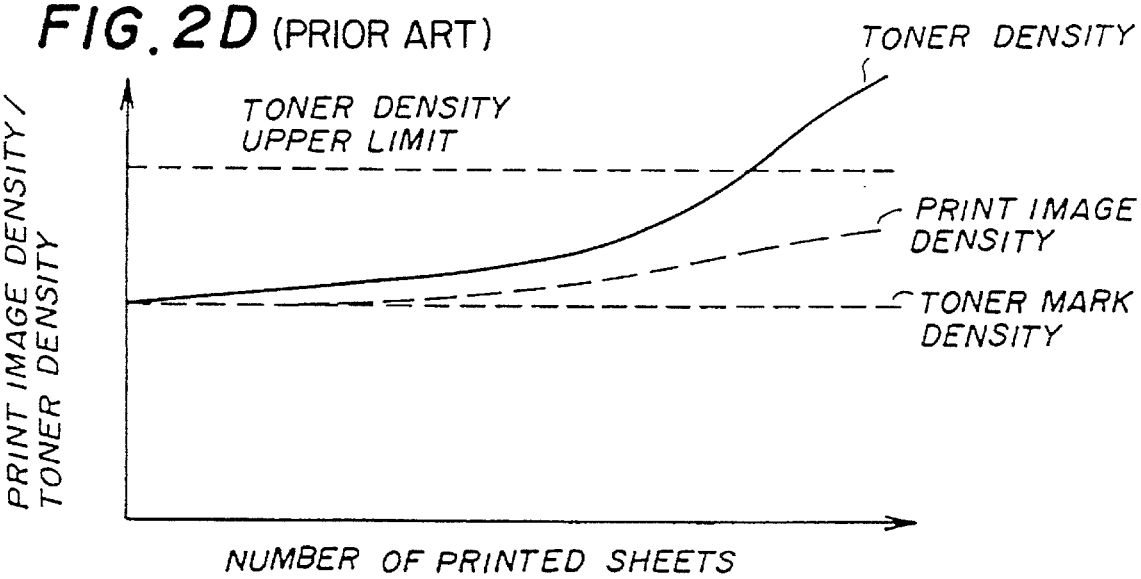
FIG. 2D (PRIOR ART)

The developing characteristic gradually deteriorates from the initial condition in the progress of use, and is changed as shown in FIG. 2C. That is, the developing characteristic does not match the characteristic of the two-component developer in the progress of use, and the real toner density does not coincide with the target toner density.

When the CPU 221 detects that 200,000≦N≦400,000 (step S12), it selects the toner mark B1 by referring to the table 21 (step S14). The pattern of the toner mark B1 is recorded on the photosensitive drum 10, and the CPU 221 reads the sensor output signal V (step S16). Then, the CPU 221 compares the sensor output signal V with the threshold level SL (step S17). When V≦SL, toner is supplied to the developing unit 13 (step S18). The characteristic of the two-component developer has deteriorated and hence the print image density has become lower than the initial density. Hence, the toner mark B1 is selected and the toner supply is controlled so that the toner density is equal to 4.5 wt % in order to compensate for the decrease in the print image density.

The developing characteristic of the developer further deteriorates in the progress of use thereof. When the CPU 221 detects that N≧400,000 (step S12), the CPU 221 selects the toner mark A1 (step S15). The pattern of the toner mark A1 is recorded on the photosensitive drum 20, and the CPU 221 reads the sensor output signal V (step S16). Then, the CPU 221 compares the sensor output signal V with the threshold level SL (step S17). When V≦SL, toner is supplied to the developing unit 13 (step S18). The print image density has further deteriorated because of deterioration of the developing characteristic of the developer. Hence, the toner mark A1 is selected and the toner supply is controlled so that the toner density is equal to 5.0 wt % in order to compensate for a further decrease in the print image density.

Figure 10B:
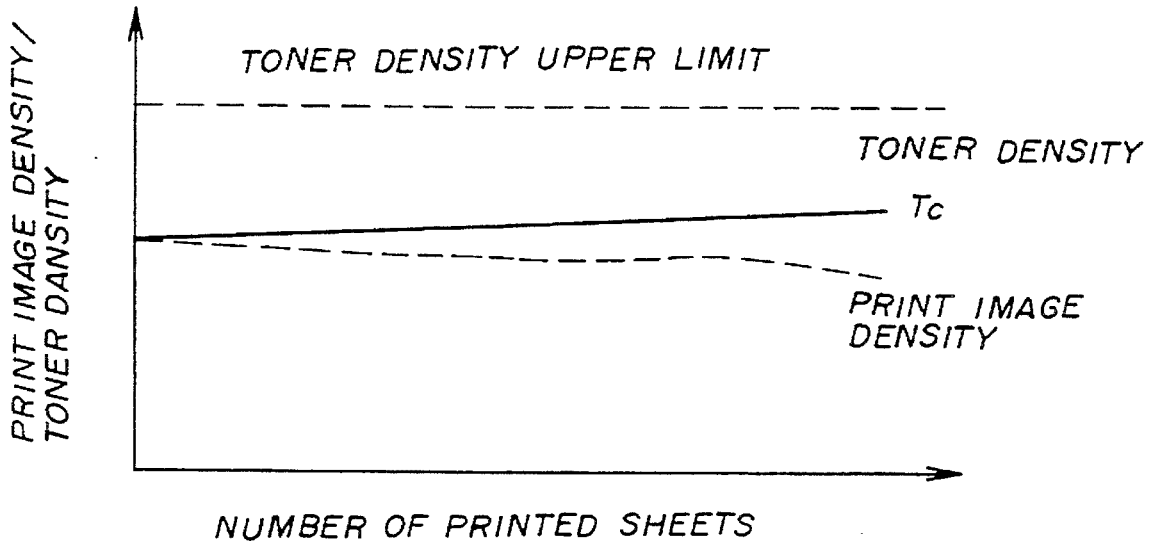

As shown in FIG. 10B, the toner density slightly increases so as to compensate for deterioration of the developer as the number of printed sheets increases, although the print image density slightly decreases. The print image quality obtained at a slightly lower print image density is better than the quality of print images in which background noise appears because of uncharged toner particles. FIG. 10B shows that when the toner marks dependent on deterioration of the two-component developer are selectively used, the toner mark density correctly corresponds to the print image density. Hence, it is possible to correctly supply toner to the developing unit 13 by means of the detection of the optical toner mark density.

As a result, background noise and scattering of toner particles because of uncharged toner particles can be prevented. Further, it is possible to maintain the print image density at the target level even when the two-component developer considerably deteriorates. This means that the lifetime of the two-component developer can be lengthened.

The present invention is not limited to the specifically disclosed embodiment. For example, the present invention is not limited to the specifically described electrophotographic printing device, and includes all printing devices using two-component developers, such as electrostatic recording devices using electrostatic latent image carrying members made of a dielectric member. In lieu of the number of printed sheets, it is possible to estimate deterioration of the two-component developer by detecting the working time of the printing device (photosensitive drum 10). Further, the present invention covers the printing devices alone or other devices equipped with printing devices, such as copying machines and facsimile machines. The toner marks are not limited to those as shown in FIGS. 4A–4C and 7A–7C. The patterns of the toner marks can be determined, taking into account the type of two-component developer, the contents of print images, and the characteristic of the photosensitive drum 10.

What is claimed is:

1. A toner supply control system for a printing device comprising:

electrostatic image carrying means for carrying a latent image;

toner supply means for supplying a two-component toner containing toner particles and carrier particles;

storage means for storing information concerning a plurality of toner supply control marks;

first control means, for generating a control signal based on a condition of the two component toner;

toner mark selector means, coupled to said storage means, for selecting a mark from the plurality of toner supply control marks based on said control signal;

toner supply control mark forming means for forming the selected mark of said plurality of toner supply control marks on the electrostatic image carrying means;

detector means for optically reading said formed selected mark and generating a detection signal; and second control means, coupled to said toner supply means and said detector means, for controlling the toner supply means based on said detection signal.

2. The toner supply control system as claimed in claim 1, further comprising counter means for counting the number of sheets which have been printed, and wherein said first control means comprises means for generating said control signal on the basis of the number of sheets counted by said counter means.

3. The toner supply control system according to claim 2, wherein said means of said first control means comprises decision means for making a decision as to which one of predetermined number-of-sheets ranges the number of sheets counted by said counter means falls into and for generating said control signal on the basis of the decision.

4. The toner supply control system as claimed in claim 1, further comprising means for measuring a working time of the printing device, and wherein said first control means comprises means for generating said control signal on the basis of said working time.

5. The toner supply control system according to claim 4, wherein said means of said first control means comprises decision means for making a decision which one of predetermined working time ranges the working time measured by said means falls into and for generating said control signal on the basis of the decision.

6. The toner supply control system as claimed in claim 1, wherein said toner supply control marks have patterns such that detection signals generated by said sensor means and related to the toner marks have different detection signal vs. toner density characteristics.

7. The toner supply control system as claimed in claim 6, wherein said different detection signal vs. toner density characteristics respectively indicate different target toner densities for a predetermined reference level defined on the basis of the detection signals.

8. The toner supply control system for a printing device of claim 1 wherein the condition of the toner is indicated by the working time of said toner.

9. The toner supply control system for a printer device of claim 1 wherein the condition of the toner is indicated by the deterioration state of said toner.

10. A printing device comprising:

electrostatic image carrying means for carrying a latent image;

a developing unit for developing said latent image;

toner supply means for supplying a two-component toner containing toner particles and carrier particles;

storage means for storing information concerning a plurality of toner supply control marks;

first control means, for generating a control signal based on a condition of the two component toner; and toner mark selector means, coupled to said storage means, for selecting a mark from the plurality of toner supply control marks based on said control signal;

toner supply control mark forming means for forming the selected mark of said plurality of toner supply control marks on the electrostatic image carrying means;

detector means for optically reading said formed selected mark and generating a detection signal; and second control means, coupled to said toner supply means and said detector means, for controlling the toner supply means based on said detection signal.

11. The printing device as claimed in claim 10, further comprising counter means for counting the number of sheets which have been printed, and wherein said first control means comprises means for generating said control signal on the basis of the number of sheets counted by said counter means.

12. The printing device as claimed in claim 10, further comprising means for measuring a working time of the printing device, and wherein said first control means comprises means for generating said control signal on the basis of said working time.

13. A toner supply control method for a printing device, comprising the steps of:

(a) detecting a condition of a two-component developer, the condition having a plurality of possible states, and determining the state of the condition from the plurality of possible states;

(b) selecting one of a plurality of different toner marks, each toner mark of the different toner marks corresponding respectively to one of the plurality of possible states, the toner mark selected being the toner mark which corresponds to the state determined in step (a);

(c) forming the toner mark selected in step (b) on an electrostatic latent image carrying member of the printing device and developing the toner mark selected in step (b) by a developing unit supplied with the two component developer;

(d) optically reading the toner mark formed and developed in step (c) and generating a detection signal related to the optically read toner mark; and (e) determining, on the basis of the detection signal, whether or not toner should be supplied to the developing unit.

14. The toner supply control method as claimed in claim 13, wherein the step (a) comprises the steps of:

(a-1) counting the number of sheets which have been printed; and (a-2) comparing the number of sheets counted by the step (a-1) with predetermined number-of-sheets ranges.

15. The toner supply control method as claimed in claim 13, wherein the step (a) comprises the steps of:

(a-1) measuring a working time of the printing device; and (a-2) comparing the working time measured in the step (a-1) with predetermined working time ranges.

16. The toner supply control method as claimed in claim 13, wherein the steep (b) further comprises selecting said one toner mark from a plurality of toner marks each having a different pattern so that detection signals generated in step (d) have different detection signal vs. toner density characteristics.

17. The toner supply control method as claimed in claim 16, wherein step (b) further comprises having said different detection signal vs. toner density characteristics respectively indicate different target toner densities for a predetermined reference level defined in common with the detection signals.

* * * * *

UNITED STATES PATENT AND TRADEMARK OFFICE

CERTIFICATE OF CORRECTION

PATENT NO. : 5,483,328

DATED : January 9, 1996

INVENTOR(S) : Noriko KAWASAKI et al.

It is certified that error appears in the above-indentified patent and that said Letters Patent is hereby corrected as shown below:

Drawings:

FIG. 5, delete "OFF" and insert therefor --OF--.

Figure 9:
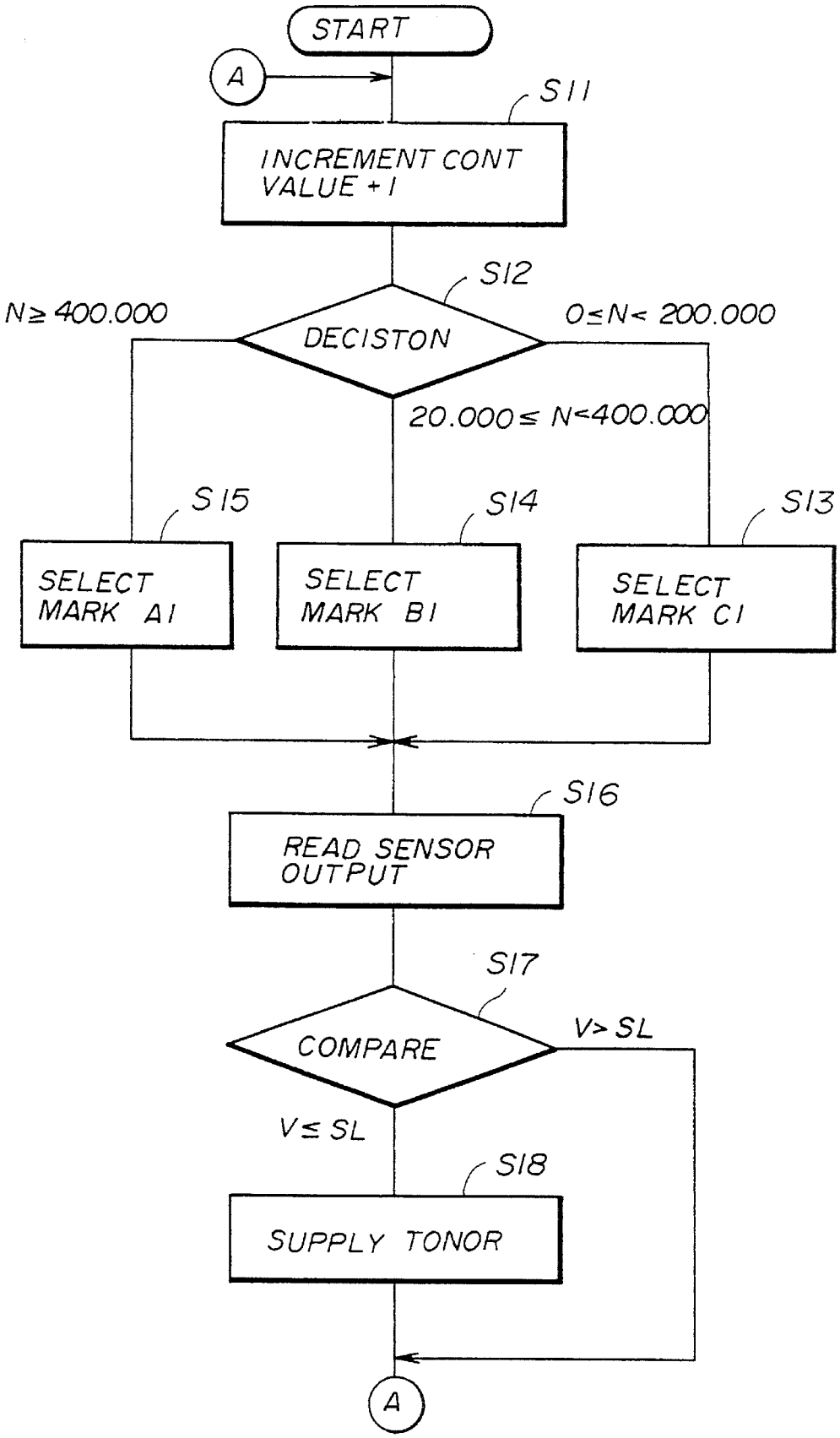
FIG. 9 is a flowchart showing the operation of the embodiment of the present invention.

FIG. 9, delete "DECISTON" and "TONOR" and insert --DECISION-- and --TONER--, respectively.

FIG. 10B, delete "DANSITY" and insert therefor --DENSITY--.

Col. 4, line 21, delete "fop" and insert therefor --for--.

Col. 10, line 26, delete "steep" and insert therefor --step--.

Signed and Sealed this

Fourth Day of June, 1996

Bruce Lehman

*Attest:*

BRUCE LEHMAN

*Attesting Officer*

*Commissioner of Patents and Trademarks*